US005359147A

United States Patent [19]

Satoh

[11] Patent Number: 5,359,147

[45] Date of Patent: Oct. 25, 1994

[54] ELECTROSTATIC LATENT IMAGE DEVELOPER

[75] Inventor: Noriaki Satoh, Nagoya, Japan

[73] Assignee: Brother Kogyo Kabushiki Kaisha, Japan

[21] Appl. No.: 135,343

[22] Filed: Oct. 13, 1993

[30] Foreign Application Priority Data

Dec. 24, 1992 [JP] Japan ..... 4-344355

[51] Int. Cl.[5] ..... G03G 15/08

[52] U.S. Cl. ..... 118/653; 430/106.6; 430/109; 430/111; 430/137

[58] Field of Search ..... 355/251; 118/653, 656–658; 430/105, 106.6, 106, 107–111, 137

[56] References Cited

U.S. PATENT DOCUMENTS 4,957,840 9/1990 Sakashita et al. ..... 430/106.6

5,009,973 4/1991 Yoshida et al. ..... 355/251 X 5,053,305 10/1991 Aoki et al. ..... 430/111

*Primary Examiner*—A. T. Grimley

*Assistant Examiner*—William J. Royer

*Attorney, Agent, or Firm*—Oliff & Berridge

[57] ABSTRACT

An electrostatic latent image developer is composed of 10 to 70 parts by weight of a magnetic toner including at least a magnetic powder and a resin, the toner having an average particle size of 5 to 10 μm, a bulk density of at least 0.4 g/cm, a coherence of not larger than 20%, and a volume resistivity of at least $10^9$ Ω cm at an AC electric field of 1 kHz, and 30 to 90 parts by weight of a carrier made of a transition oxide, the carrier having an average particle size of 30 to 70 μm. The toner is uniformly charged so that quick rising-up of the charge is possible. The developer provides high quality, uniform images without blurring.

15 Claims, 1 Drawing Sheet

ELECTROSTATIC LATENT IMAGE DEVELOPER

BACKGROUND OF THE INVENTION

1. Field of the Invention

The present invention relates to a developer for developing electrostatic latent images. The developer is adapted for use in image recording apparatus such as copying machines and printers. More particularly, the invention relates to an electrostatic latent image developer useful in an image recording apparatus wherein the electrostatic latent image developer is controlled based on image information retrieved as electric signals to form images directly on a recording member.

2. Description of Related Art

Electrophotographic image recording methods and electrostatic image recording methods are widely used in copying machines, printers and the like. Most electrostatic latent image developers are used in these fields. Developers used in these methods are broadly classified into two groups. The first group of developers includes non-magnetic one-component developers used to develop only with colored particles comprising at least a resin ingredient and a pigment. The second group includes two-component developers which comprise a magnetic one-component developer comprising, at least, magnetic powder such as magnetite and a resin, and a mixture of particles called a carrier, such as magnetite, glass beads and the like, which are apparently greater in size than colored particles of the non-magnetic one-component developer, with colored particles as used in the non-magnetic one-component developer.

As an intermediate developer between the one-component developer and the two-component developer, a 1.5-component developer is known wherein a carrier is mixed with the magnetic one-component developer. The two-component developer comprises 90 to 95% of a carrier and 5 to 10% of a developer (hereinafter referred to as "a toner") including colored particles therein. The one-component developer, whether non-magnetic or magnetic, is completely free of any carrier and is constituted only of a toner. On the other hand, the 1.5-component developer comprises 30 to 90% of a carrier and 10 to 70% of a toner, so that this developer is called a 1.5-component developer in the sense that it is an intermediate between the one-component developer and the two-component developer.

In ordinary electrophotographic methods using a one- or two-component developer, an electrically latent image is formed on a photosensitive material made of a photoconductive material and the latent image is developed to provide a visible image. The visible image is then fixed, as it is or after transfer, on a recording medium on which the image is to be formed by the application of heat or pressure.

However, known electrophotographic and electrostatic recording methods have various problems when a high degree of image resolution is needed. To form images of high resolution, the particle size should be small. The toner produced by a grinding procedure limits the minimum particle size to approximately 7 μm. Forming a finer sized toner is almost impossible so far as fine powder is removed, thus placing a limit on image resolution. On the other hand, when a toner is produced through polymerization, toner particles having a size not larger than 7 μm may be formed, with the likelihood of a high degree of resolution. However, polymer particles deposited on the photosensitive material made of a photoconductive material are not easily removed in existing image recording apparatus, thereby causing a failure in cleaning.

With the charging system of a known two-component developer using a carrier, the amount of toner deposited is limited relative to the carrier's specific surface area. It has been accepted that the limit of toner concentration is about 5%. With two-component development systems using a low toner concentration relative to carrier, toner consumed for the development has to be invariably supplied to a development unit in an amount corresponding to the consumption in order to keep a constant toner concentration. To this end, if an image consuming a large amount of toner is outputted, the toner cannot be supplemented satisfactorily, thereby forming an image with a low density in a subsequent output cycle.

The 1.5-component developer is made of a mixture of a carrier and a magnetic toner wherein the concentration of the toner in the developer exceeds 5%. Since the toner is magnetic in nature and has a sufficient ability to function as a one-component magnetic toner, mixing with a carrier is not always necessary. More particularly, with the 1.5-component developer, the carrier is contained so that the one-component magnetic toner is made up for with respect to the chargeability and image quality is improved.

However, known toners have a bulk density of not larger than 0.4 g/cc or a cohesion of not larger than 20%. This means that the contact area is so small that the toner is not subjected to triboelectric charging to an extent sufficient to complement the charge of the toner.

SUMMARY OF THE INVENTION

The invention provides an electrostatic latent image developer which can solve the problems of the prior art and which is adapted for use in image recording apparatus, whereby images of uniform quality can be formed.

The invention provides an electrostatic latent image developer wherein a toner is uniformly charged and the rising-up speed of the charge is high, thereby obtaining a reproduced output of high-quality images.

The invention further provides an electrostatic latent image developer wherein the concentration of toner in the developer is so high that a good image quality is obtained using a small amount of carrier and with which the arrangement of an image recording apparatus can be simplified.

According to the invention, an electrostatic latent image developer is provided which comprises from 10 to 70 wt. % of a magnetic toner including at least a magnetic powder and a resin, the toner having an average particle size of from 5 to 10 μm, a bulk density of not smaller than 0.4 g/cc, a cohesion of not larger than 20%, and a volume resistivity of not less than $10^9\Omega$ cm at an AC electric field of 1 kHz, and from 30 to 90 wt. % of a carrier consisting of a transition metal oxide, the carrier having an average particle size of from 30 to 70 μm.

In the electrostatic latent image developer of the invention, it is preferred that the carrier have a volume-based average particle size of from 30 to 70 μm. The ratio by weight between the magnetic powder and the resin in the toner is preferably from 20 to 60:40 to 80. If the weight ratio of the magnetic powder is larger than those defined above, a satisfactory image density cannot be obtained. Conversely, when the amount of magnetic powder is smaller, good chargeability is not obtained. The ratio by weight of the toner and the carrier in the developer should preferably be in the range of 10 to 70:90 to 30. If the weight ratio of the toner is larger than those values in the above range, a satisfactory density is not obtained. When the weight ratio of the toner is smaller, considerable fogging occurs.

Because the developer of the invention is greater in the charge quantity of the toner and arrives at a saturation charge more rapidly than known developers, high image resolution is attained. In addition, when the developer is improved in flowability, the amount of oppositely charged toner is reduced, which suppresses fogging.

Thus, using the electrostatic latent image developer of the invention, the resolution of toner images formed on a recording member can be enhanced. The toner has increased bulk density and cohesion values as defined above, ensuring uniform charging and the unlikelihood of an uneven toner concentration. Thus, high resolution images exhibiting a reduced degree of fogging can be obtained.

BRIEF DESCRIPTION OF THE DRAWING

Preferred embodiments of the present invention will be described in detail with reference to the following FIGURE, wherein.

DETAILED DESCRIPTION OF THE PREFERRED EMBODIMENTS

Figure 1:
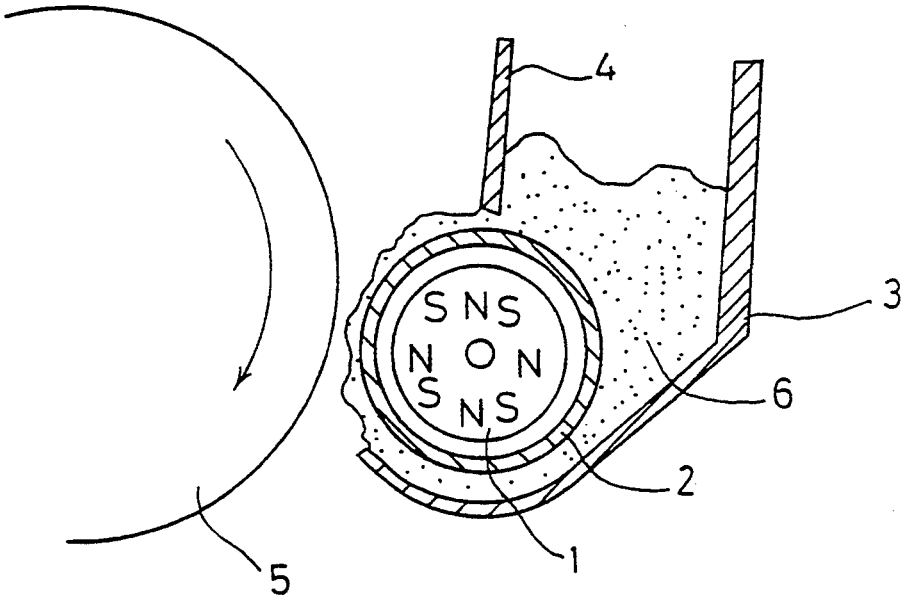
FIG. 1 is a schematic view showing a developing device using an electrostatic latent image developer according to the invention.

Reference is now made to the accompanying drawings to illustrate preferred embodiments of the invention.

In FIG. 1, a schematic arrangement of a developing device filled with an electrostatic latent image developer according to the invention is shown, described later in detail. The developing device includes a non-magnetic cylindrical sleeve 2 in face-to-face relation with a photoconductive, photosensitive drum 5. The cylindrical sleeve 2 has a magnet roll 1 having a plurality of magnetic poles in the inside thereof. An electrostatic latent image developer 6 accommodated in a toner case 3 is carried by rotation of the cylindrical sleeve 2. The thickness of the developer 6 is regulated by means of a regulation blade 4 on rotation of the sleeve 2 and the developer 6 is transferred to a position facing the photosensitive drum 5.

The magnet roll 1 may be rotated in a direction opposite to that of the cylindrical sleeve 2 or it may be fixed. Rotating the magnetic roll 1 increases the triboelectric charging of the toner and causes a larger amount of toner to be deposited on an electrostatic latent image on the photosensitive drum 5. However, the toner may not be uniformly moved through a developing gap between the cylindrical sleeve 2 and the photosensitive drum, resulting in increased toner deposition on non-image or background portions of the drum. On the other hand, when the magnet roll 1 is fixed, the quantity of charge of the toner is lowered and the image density is lowered, thus reducing the degree of toner deposition on the non-image portions of the drum.

When the magnet roll 1 is either rotated or fixed, other conditions may be properly changed to form images with satisfactory properties. The gap between the regulation blade 4 and the cylindrical sleeve 2 has a relation to the gap between the cylindrical sleeve 2 and the photosensitive drum 5. If the gap at the regulation blade 4 is smaller than the gap at the photosensitive drum 5, the developer transferred to the gap of the photosensitive drum 5 cannot be suitably passed through the latter gap and will be in excess. The ratio between the gap at the regulation blade 4 and the gap at the drum 5 should preferably be controlled in a range of 0.5 to 1. If the ratio is less than 0.5, the amount of toner used for development at the developing gap is reduced. Thus, a satisfactory image density will not be obtained. The gap between the cylindrical sleeve 2 and the photosensitive drum 5 should preferably be in the range of from 0.1 to 6 mm.

In the preferred embodiments of the invention, the carrier is constituted of mixtures of transition metal oxides and iron oxide. More particularly, useful mixtures include mixtures of oxides of nickel, zinc, manganese, magnesium, copper, lithium, barium, vanadium, chromium, calcium, iron and the like, and iron (III) oxide. If necessary, individual particles of the mixture may be coated with resins such as silicone resins, acrylic resins, fluorine resins and the like. This type of carrier is less corrosive than iron powder and is easy to make into spherical particles, resulting in good flowability. Carriers which are suitable for use in the above-stated developing device should preferably have a saturation magnetization of from 40 to 100 emu/g, a volume resistivity of $10^5$ to $10^{10}$ Ω cm at a direct current of 100 V/cm, and an average size of from 30 to 70 μm.

The toner constituting the electrostatic latent image developer of the invention may be prepared by any known grinding method. For instance, starting materials for the toner are mixed in a mixer, to obtain a uniform mixture. While melting under heating conditions, the starting mixture is further mixed in a kneader so that starting ingredients which are not miscible with one another are mixed in the form of fine particles. The toner material obtained after the kneading by the kneader is cooled down by means of pressure rolls and converted into particles by a primary crusher such as a cutter mill. Finally, the resultant coarse particles are divided into fine particles of an average size not larger than 20 μm by means of a fine grind mill such as an air jet type mill.

The resultant fine particles contain fine powder in excess which is not uniform in size distribution and is too small in size to be used as a toner for an image-forming apparatus. Accordingly, the fine particles are subjected to classification to obtain fine particles of a specific size distribution. Two or more classification operations can further improve the particles' flowability. The final fine particles may be mixed with hydrophobic silica fine particles in order to improve flowability.

The magnetic toner of the electrostatic latent image developer is constituted mainly of a binder resin and magnetic powder. Examples of useful binder resins include polystyrene, styrene-acrylic acid copolymers, styrene-maleic acid copolymers, polyacrylate resins, polyesters and the like. The magnetic powder is mainly made of magnetite.

The toner of the invention may further comprise a coloring agent, if necessary. Examples of coloring agents include pigments such as carbon black, and dyes such as nigrosine, benzidine yellow, quinacridone, rhodamine B and copper phthalocyanine blue.

Further, charge controlling agents and/or release agents may be added. Useful charge controlling agents include metal-containing dyes, nigrosine and the like, and useful releasing agents include waxes.

The developing conditions may differ greatly depending on the amount of magnetic powder in the toner. Preferably, the magnetic powder is present in an amount of from 20 to 60 parts by weight and the resin is present in the range of from 40 to 80 parts by weight, based on the total weight of the toner. When the total of the resin and the magnetic powder is taken as 100 parts by weight and the content of the magnetic powder exceeds 60 parts by weight, the saturation magnetization of the resultant toner becomes high. This leads to the attractive force exerted by the magnet roll 1 being so strong that the amount of toner deposited on an electrostatic latent image on the photosensitive drum 1 (by freeing the powder from the magnetic restraint force of the magnet roll 1) can be reduced. If the amount of magnetic powder is less than 20 parts by weight, the toner is subjected to little magnetic restraint force. As a result, the toner is likely to scatter within the device and not be charged satisfactorily, thereby permitting the toner to be deposited on non-image portions of the photosensitive drum and causing fogging.

The toner in the electrostatic latent image developer 6 of the invention should preferably have a volume resistivity of not less than $10^9$ Ω cm at an AC voltage of 1 kHz. If the volume resistivity is lower, satisfactory triboelectricity is not attained, resulting not only in a lowering of the image density but also in an increased amount of scattered particles on non-image portions of the photosensitive drum. The toner's particle size should preferably be in the range of from 5 to 10 μm and more preferably from 6 to 9 μm. A smaller particle size results in a higher image resolution. If, however, triboelectricity is not at a satisfactory level, the resultant images suffer a significant degree of fogging in a low image density. The limit on the average toner particle size is 5 μm. Toner particles having an average size larger than 10 μm are free of fogging and are not lower in image density. However, the particles are scattered around individual letters, preventing development of the electrostatic latent image along the strength of the electric field.

The ratio between the toner and the carrier should preferably be such that 10 to 70 parts by weight of the toner and 30 to 90 parts by weight of the carrier are used. If the toner is less than 10 parts by weight, such a developing system is nothing other than the two-component charging system, thus requiring supplement of the toner. Preferably, the toner should be present in amounts not less than 20 parts by weight.

When the toner content exceeds 70 parts by weight, the toner is less contacted with the carrier, which does not arrive at the saturation level of charge. Thus, a toner of reverse polarity is increased in amount, resulting in an appreciable degree of fogging on non-image portions of the photosensitive drum. When the total is taken as 100 parts by weight, the content of the carrier is varied relative to the toner. The same problems as in the case of the toner arise: when the content of the carrier exceeds 90 parts by weight, the developing system is the same as the two-component system; and when the content is less than 30 parts by weight, such a developing system is close to a magnetic one-component developing system, resulting in a considerable degree of scattering.

The thus mixed electrostatic latent image developer 6 is deposited on the cylindrical sleeve 2. The photosensitive drum 5 is rotated in the direction indicated by the arrow in FIG. 1 at a rate of 50 to 100 r.p.m. The number of revolutions of the cylindrical sleeve 2 which is provided at a position adjacent to the photosensitive drum 5 differs depending on whether the magnet roll 1 is rotated or fixed in position. Since the toner should be supplied to the electrostatic latent image on the photosensitive drum 5 in amounts sufficient for development, the sleeve 2 is rotated at 150 to 250 r.p.m. when the magnet roll 1 is fixed. When the magnet roll 1 is rotated, its number of revolutions ranges from 400 to 900 r.p.m. Accordingly, the cylindrical sleeve is rotated at 50 to 100 r.p.m. in the same direction as the photosensitive drum in order to supply a sufficient amount of toner for development.

The preparation of the toners according to the invention which are used in the above-stated image-forming apparatus is described by way of the following examples.

EXAMPLE 1

| | |
|---|---|
| Styrene-butyl acrylate copolymer (TBH1500 manufactured by SANYO CHEMICAL INDUSTRIES, LTD.) | 45 parts by weight |
| Magnetite (EPT-1000 manufactured by TODA KOGYO CORP.) | 55 parts by weight |
| Carbon black (MA100 manufactured by MITSUBISHI KASEI CORPORATION) | 10 parts by weight |
| Charge controlling agent (S-34 manufactured by ORIENT CHEMICAL. CO., LTD.) | 2 parts by weight |
| Wax (550P manufactured by SANYO CHEMICAL INDUSTRIES, LTD.) | 4 parts by weight |

A mixture of the above ingredients was melted and kneaded. After cooling, the mixture was milled using an air jet grinding machine, followed by size classification twice, to obtain particles having an average size of 8.5 μm. 0.5 parts by weight of hydrophobic silica (Aerosil R972) was added to 100 parts by weight of the particles. As a result, a toner was obtained having a bulk density of 0.518 g/cc, a coherence of 8.9%, a charge quantity of −48 μC when determined using a two-component blow-off charge meter, and a volume resistivity of 3.5 * $10^{10}$ Ω cm. The toner was mixed with a ferrite carrier having an average particle size of 75 μm at a weight ratio of toner:carrier=40:60. The mixture was filled in a developing device under conditions where the magnet roll was fixed and the cylindrical sleeve was rotated at 200 r.p.m., and subjected to image formation. As a result, uniform images with a reflection density of 1.6 were formed wherein the amount of scattered toner was small.

COMPARATIVE EXAMPLE 1

The composition of Example 1 was used except that the classification was effected only once, thereby obtaining a toner having a bulk density of 0.398 g/cc and a coherence of 15.6%. The toner was mixed with a ferrite carrier having an average size of 75 μm at the same mixing ratio as in Example 1. The mixture was filled in the same device as in Example 1 and subjected to image formation. As a result, the image density of the toner developed on the recording medium was 0.8 at some portions and 1.2 at other portions. Thus, the image was not uniform in density.

COMPARATIVE EXAMPLE 2

A carrier of the same type as used in Example 1 was mixed with a known toner having a bulk density of 0.375 g/cc and a coherence of 22.8%. The mixture was filled in the same developing device as in Example 1 and subjected to image formation. As a result, fogging appeared and the density of the toner developed on the recording medium was 0.9 at some portions and 1.1 at other portions. Thus, the image was not uniform in density.

EXAMPLE 2

| | |
|---|---|
| Styrene-butyl acrylate copolymer (UNI3000 manufactured by SANYO CHEMICAL INDUSTRIES, LTD.) | 60 parts by weight |
| Magnetite (EPT-1000 manufactured by TODA KOGYO CORP.) | 35 parts by weight |
| Wax (550P manufactured by SANYO CHEMICAL INDUSTRIES, LTD.) | 5 parts by weight |
| Charge controlling agent (FCA1001NB manufactured by FUJIKURA KASEI CO., LTD.) | 4 parts by weight |

A mixture of the above ingredients was melted and kneaded. After cooling, the mixture was milled using an air jet grinding machine, followed by classification twice, to obtain particles having an average size of 8.1 μm. 0.5 parts by weight of hydrophobic silica (Wacker Chemical H2000) was added to 100 parts by weight of the particles. As a result, a toner was obtained having a bulk density of 0.486 g/cc, a coherence of 4.8%, a charge quantity of −34 μC when determined using a two-component blow-off charge measuring meter manufactured by TOSHIBA CHEMICAL CORPORATION, a volume resistivity of $4.0 * 10^{10}$ Ω cm, and a dielectric constant of 3.1. The toner was mixed with a magnetite carrier having an average particle size of 70 μm at a weight ratio of toner:carrier=40:60. The mixture was filled in a developing device under conditions where the magnet roll was rotated and the cylindrical sleeve was rotated at 200 r.p.m., and subjected to image formation. As a result, uniform images were formed having a reflection density of 1.8 wherein the amount of scattered toner was small.

COMPARATIVE EXAMPLE 3

The same composition as in Example 2 was used except that the classification was effected only once, thereby obtaining a toner having a bulk density of 0.365 g/cc and a coherence of 14.3%. The toner was mixed with a magnetite carrier having an average size of 70 μm at the same mixing ratio as in Example 2. The mixture was filled in the same device as in Example 2 and subjected to image formation. As a result, the image density of the toner developed on the recording medium was 1.0 at some portions and 1.5 at other portions. Thus, the image was not uniform in density.

COMPARATIVE EXAMPLE 4

A magnetite carrier of the same type as used in Example 2 having a size of 70 μm was fixed with a known toner having a bulk density of 0.439 g/cc and a coherence of 32.8% at a mixing ratio by weight of toner:carrier=40:60. The mixture was filled in the same developing device as in Example 2 wherein the magnet roll was fixed and subjected to image formation. As a result, fogging appeared and the density of the toner developed on the recording medium was 1.3 at some portions and 1.6 at other portions. Thus, the image was not uniform in density.

The results of the above examples are summarized in the following table:

| | Fogging | Density | Charge Quantity | Scattering |
|---|---|---|---|---|
| Example 1 | G | F | G | G |
| Compar. Ex. 1 | P | P | F | P |
| Compar. Ex. 2 | P | P | P | F |
| Example 2 | G | F | G | G |
| Compar. Ex. 3 | F | P | F | P |
| Compar. Ex. 4 | P | G | P | P |

Evaluation Standards:

G: Good

F: Fair

P: Poor

Fogging: A difference in whiteness between the back side of a printed recording member and a background portion at the front side.

Density: Measurement by a Macbeth densitometer.

Charge Quantity: Measurement by a two-component blow-off charge measuring device manufactured by Toshiba Chemical Corporation.

Scattering: A scattering rate derived from image processing of printed image.

As will be apparent from the foregoing description, when the electrostatic latent image developers of the invention are used the resolution of toner images formed on a recording member can be improved. When the toner is increased in bulk density and coherence, uniform charging becomes possible in the uniform density of toner. Thus, high resolution images may be obtained which are unlikely to exhibit fogging.

The invention is not limited to the examples described above. Various modifications and variations may be made without departing from the scope of the invention as defined by the appended claims.

What is claimed is:

1. An electrostatic latent image developer comprising:

a magnetic toner comprising a magnetic powder and a resin, the magnetic toner having an average particle size of from 5 to 10 μm, a bulk density of at least 0.4 g/cc, a cohesion not larger than 20%, and a volume resistivity of at least $10^9$ Ω cm at an AC electric field of 1 kHz; and a carrier comprising a transition metal oxide, the carrier having an average particle size of from 30 to 70 μm.

2. The electrostatic latent image developer as claimed in claim 1, comprising 10 to 70 wt. % of the magnetic toner and 30 to 90 wt. % of the carrier.

3. The electrostatic latent image developer as claimed in claim 1, wherein a ratio by weight of magnetic powder to resin in the toner is from 20 to 60:40 to 80.

4. The electrostatic latent image developer as claimed in claim 1, wherein the magnetic powder comprises magnetite.

5. The electrostatic latent image developer as claimed in claim 1, wherein the resin is selected from the group consisting of polystyrene, styrene-acrylic acid copolymers, styrene-maleic acid copolymers, polyacrylate resins, and polyesters.

6. The electrostatic latent image developer as claimed in claim 1, wherein the toner further comprises a coloring agent.

7. The electrostatic latent image developer as claimed in claim 1, wherein the carrier comprises a mixture of a transition metal oxide and iron oxide.

8. The electrostatic latent image developer as claimed in claim 1, wherein the carrier has a saturation magnetization of from 40 to 100 emu/g and a volume resistivity of $10^5$ to $10^{10}$ Ω cm at a direct current of 100 V/cm.

9. A method of making an electrostatic latent image developer, comprising:

(a) preparing a magnetic toner by forming a mixture comprising a magnetic powder and a resin, melting and kneading the mixture, and cooling and grinding the mixture to form toner particles having an average particle size of from 5 to 10 μm, a bulk density of at least 0.4 g/cc, a cohesion not larger than 20%, and a volume resistivity of at least $10^9$ Ω cm at an AC electric field of 1 kHz; and (b) mixing the magnetic toner with a carrier to form an electrostatic latent image developer, the carrier comprising a transition metal oxide having an average particle size of from 30 to 70 μm.

10. The method of claim 9, wherein the electrostatic latent image developer comprises 10 to 70 wt. % of the magnetic toner and 30 to 90 wt. % of the carrier.

11. The method of claim 9, wherein the magnetic powder comprises magnetite.

12. The method of claim 9, wherein the resin is selected from the group consisting of polystyrene, styrene-acrylic acid copolymers, styrene-maleic acid copolymers, polyacrylate resins, and polyesters.

13. The method of claim 9, further comprising adding a coloring agent to the magnetic toner.

14. The method of claim 9, wherein the carrier comprises a mixture of a transition metal oxide and iron oxide.

15. The method of claim 9, wherein the carrier has a saturation magnetization of from 40 to 100 emu/g and a volume resistivity of $10^5$ to $10^{10}$ Ω cm at a direct current of 100 V/cm.

* * * * *